US006971356B2

(12) United States Patent
Diestelmeier

(10) Patent No.: US 6,971,356 B2
(45) Date of Patent: Dec. 6, 2005

(54) ENGINE PUSHROD

(75) Inventor: Stephen Alan Diestelmeier, Rockford, IL (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 10/354,282

(22) Filed: Jan. 30, 2003

(65) Prior Publication Data

US 2004/0149244 A1 Aug. 5, 2004

(51) Int. Cl.[7] ..... F01L 1/14
(52) U.S. Cl. ..... 123/90.61; 123/90.48; 29/888.03; 403/265
(58) Field of Search ..... 123/90.61, 90.48; 403/265, 266, 267, 268, 269, 359.6; 29/888.03

(56) References Cited

U.S. PATENT DOCUMENTS 4,394,851 A * 7/1983 Greier et al. ..... 123/182.1
4,453,505 A * 6/1984 Holtzberg et al. ..... 123/90.61
5,027,763 A * 7/1991 Mallas ..... 123/90.61
5,690,444 A * 11/1997 Yuuki et al. ..... 403/268

FOREIGN PATENT DOCUMENTS

JP 09119298 A * 5/1997 ..... E21D 20/00

* cited by examiner

*Primary Examiner*—Thomas Denion
*Assistant Examiner*—Zelalem Eshete
(74) *Attorney, Agent, or Firm*—Trexler, Bushnell, Giangiorgi, Blackstone & Marr, Ltd.

(57) ABSTRACT

An engine pushrod which includes a plastic shaft in the form of a rod or tube, and a metal cap on at least one of the ends of the plastic shaft. The plastic shaft may be a molded plastic rod made from an engineered resin material, and may take one of several different shapes, such as a round or "T-shaped" cross-sectional profile. There may be a metal cap on both ends of the plastic shaft, and each of the metal caps may be shaped with a stamping process and hardened. The caps may be crimped onto the ends of the plastic shaft or they may be insert molded. Preferably, either method provides a part with excellent TIR and surface finish, and which meets torque requirements. Preferably, the assembly is lightweight and meets all requirements and the resin material is high temperature resistant and oil resistant.

11 Claims, 9 Drawing Sheets

ENGINE PUSHROD

BACKGROUND

This invention generally relates to engine pushrods, and more specifically relates to a plastic pushrod which is lightweight and easy to manufacture.

Pushrods are often used in small engines, and sometimes used in both the intake and exhaust sides of the engine. Engine pushrods are typically made of steel or aluminum. In the case of a steel pushrod, typically a hardened, polished steel ball is welded to each end of a steel tube. One disadvantage to such a design is that steel rods are heavy in weight. Additionally, the welding process to attach the steel balls to the rod can be inconsistent, and TIR on parts can vary from lot to lot. Furthermore, because the steel rod is extruded, surface finish can be a problem.

In the case of an aluminum pushrod, typically either an aluminum tube is used and the ends of the tube are press fit into the inside diameter of the tube, or a solid aluminum rod is used and a hole is drilled into each end, and then a hardened end piece is press fit into the hole in each end of the aluminum rod. Both aluminum pushrod designs present a disadvantage in that the aluminum tube or rod typically initially comes in the form of a coil and must be straightened. Therefore, there may be problems with TIR. Surface finish can also be a problem since the tube or rod is extruded. With regard to a design where a solid aluminum rod is used and holes are drilled into the ends, drilling a hole in the end of the solid rod can be inconsistent and cause TIR problems. Additionally, the end portions which are press fit into the holes may fall out if the hole size is not tightly controlled. Torque can also be a problem related to hole size.

SUMMARY

An object of an embodiment of the present invention is to provide an engine pushrod which is lightweight and easy to manufacture.

Another object of an embodiment of the present invention is to provide an engine pushrod which provides excellent TIR, surface finish, and meets torque requirements.

Still another object of an embodiment of the present invention is to provide an engine pushrod which provides ends which are hardened to provide a wear surface against the mating component in the engine.

Yet still another object of an embodiment of the present invention is to provide an engine pushrod which is high temperature resistant and oil resistant.

Still yet another object of an embodiment of the present invention is to provide an engine pushrod which has few manufacturing variables.

Yet another object of an embodiment of the present invention is to provide an engine pushrod which has a consistent surface finish.

Yet still another object of an embodiment of the present invention is to provide an engine pushrod which can be tested using non-destructive testing methods.

Yet still another object of an embodiment of the present invention is to provide an engine pushrod which obviates the need to use secondary processes to meet surface finish requirements.

Briefly, and in accordance with at least one of the foregoing objects, an embodiment of the present invention provides an engine pushrod which includes a plastic shaft in the form of a rod or tube, and a metal cap on at least one of the ends of the plastic shaft. The plastic shaft may be a molded plastic rod made from an engineered resin material, and may take one of several different shapes, such as a round or "T-shaped" cross-sectional profile. There may be a metal cap on both ends of the plastic shaft, and each of the metal caps may be shaped with a stamping process and hardened. The caps may be crimped onto the ends of the plastic shaft or they may be insert molded. Preferably, either method provides a part with excellent TIR and surface finish, and which meets torque requirements. Preferably, the assembly is lightweight and meets all requirements and the resin material is high temperature resistant and oil resistant.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
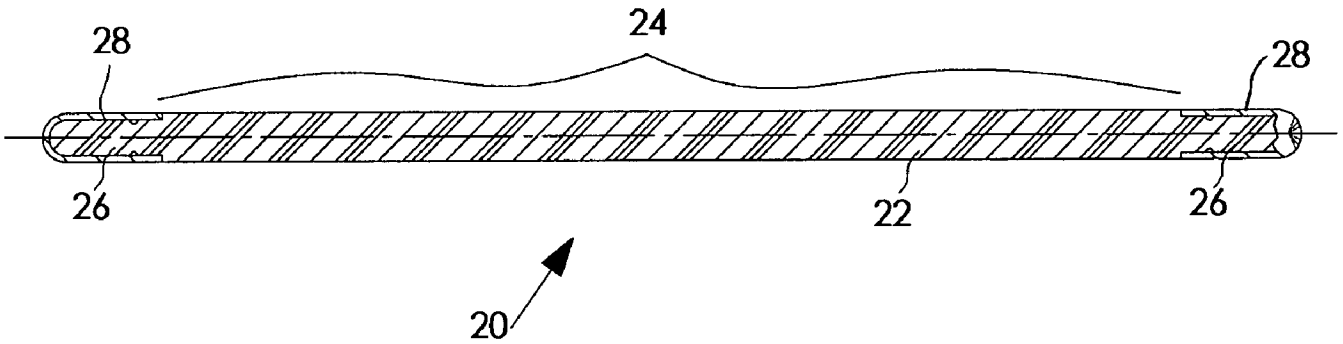
FIG. 1 is a partial cross-sectional view of an engine pushrod which is in accordance with an embodiment of the present invention.

While the present invention may be susceptible to embodiment in different forms, there are shown in the drawings, and herein will be described in detail, embodiments thereof with the understanding that the present description is to be considered an exemplification of the principles of the invention and is not intended to limit the invention to that as illustrated and described herein.

Several engine pushrods in accordance with different embodiments of the present invention are illustrated in the FIGURES. Each pushrod includes a plastic shaft in the form of a rod or tube, and a metal cap on at least one of the ends of the plastic shaft. Each of the engine pushrods is lightweight and easy to manufacture.

Figure 2:
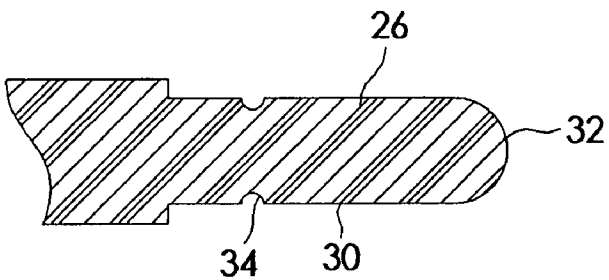
FIG. 2 is an enlarged view of an end of a plastic rod of the pushrod shown in FIG. 1.

FIG. 1 illustrates an engine pushrod 20 which is in accordance with an embodiment of the present invention. The engine pushrod 20 includes a plastic shaft 22 in the form of a solid rod having a round cross-sectional profile. The plastic rod 22 is preferably a molded plastic rod made from an engineered resin material. Preferably, the resin material is high temperature resistant and oil resistant. The rod includes an elongated middle portion 24 and end portions 26. Preferably, the end portions 26 are configured to receive end caps 28. Specifically, as best shown in FIG. 2, each of the end portions 26 may provide a reduced diameter portion 30 having a rounded end 32 and a circumferential notch 34, wherein the notch 34 is configured to enhance the securement between the end cap 28 and the end portion 26 of the rod 22. With regard to the end caps 28, preferably they are metal and are stamped into a shape which generally corresponds to the end portion 26 of the plastic rod 22, and are hardened to provide a wear surface against the mating components in the engine in which the pushrod 20 is employed. In the embodiment shown in FIG. 1, the end caps 28 are crimped onto the ends 26 of the plastic rod. The circumferential notches 34 on the end portions 26 of the plastic rod 22 capture the crimp of the end caps 28, thereby enhancing the securement of the end caps 28 and providing improved torque characteristics. The engine pushrod 20 has excellent TIR and surface finish, and meets torque requirements. The pushrod 20 has less manufacturing variables than current, widely-used pushrod designs. The surface finish on the pushrod 20 is preferably more consistent and better than extruded steel or aluminum rod or tube. Preferably, the TIR on the pushrod 20 is lower and more consistent than is provided current, widely-used manufacturing methods. The crimping method of attaching the hardened ends 28 is more consistent and can be visually checked compared to welding which requires a destructive test to determine weld quality. The crimped ends 28 can be verified with a caliper or micrometer. Preferably, the end caps 28 are consistently the same and no secondary processes, such as polishing, are needed to meet surface finish requirements.

Figure 3:
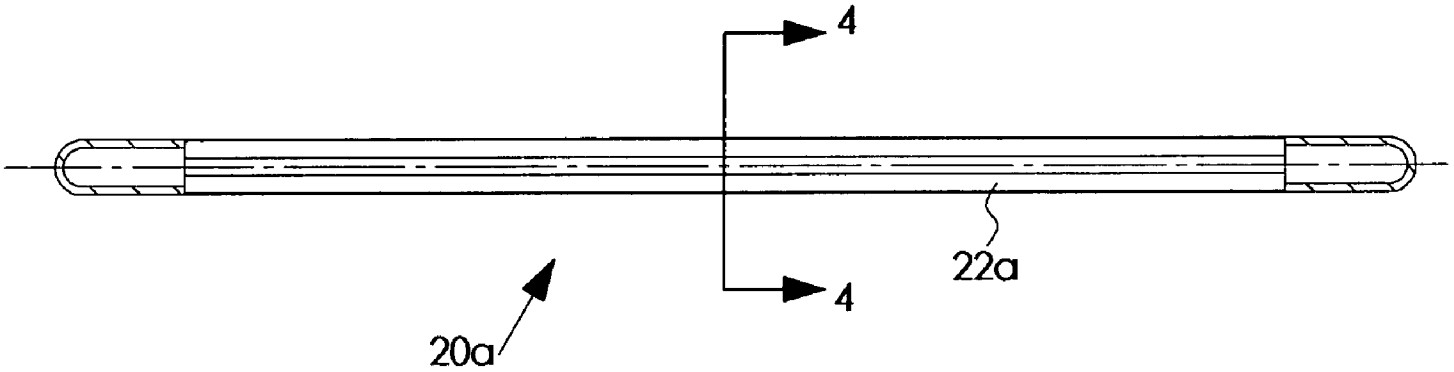
FIG. 3 is a side, elevational view of an engine pushrod which is in accordance with another embodiment of the present invention.
Figure 4:
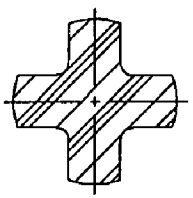
FIG. 4 is a cross-sectional view of the engine pushrod shown in FIG. 3, taken along line 4—4 of FIG. 3.

FIG. 3 illustrates an engine pushrod 20*a* which is very similar to that which is shown in FIG. 1, but where the engine pushrod 20*a*, and specifically the plastic rod portion 22*a* thereof, has a "T-shaped" cross-sectional profile as shown in FIG. 4.

Figure 5:
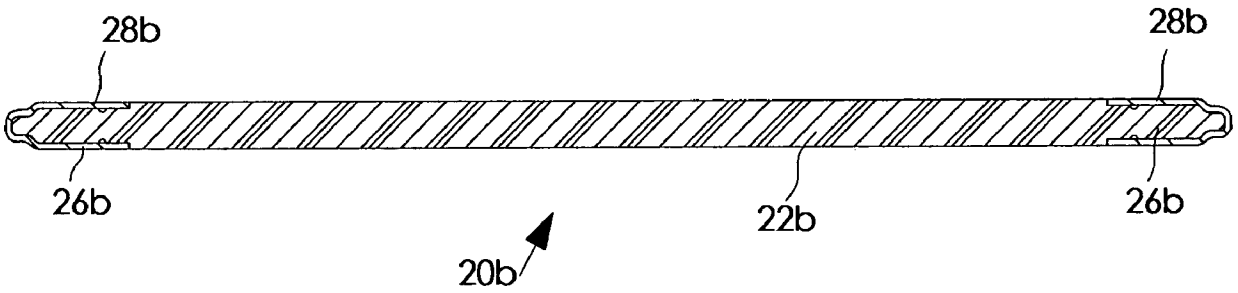
FIG. 5 is a side, elevational view of an engine pushrod which is in accordance with yet another embodiment of the present invention.
Figure 6:
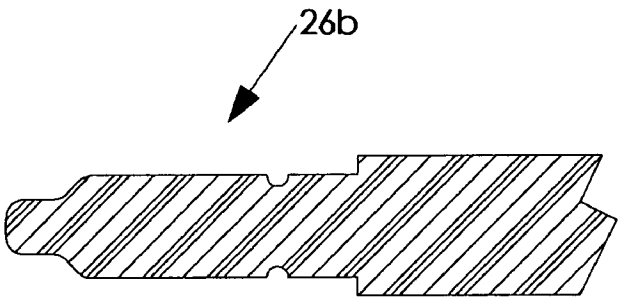
FIG. 6 is an enlarged view of an end of a plastic rod of the pushrod shown in FIG. 5.

FIG. 5 illustrates an engine pushrod 20*b* which is very similar to that which is shown in FIG. 1, but where the end portions 26*b* of the plastic rod 22*b* (see FIG. 6) and corresponding end caps 28*b* are shaped somewhat differently than which is shown in FIG. 1.

Figure 7:
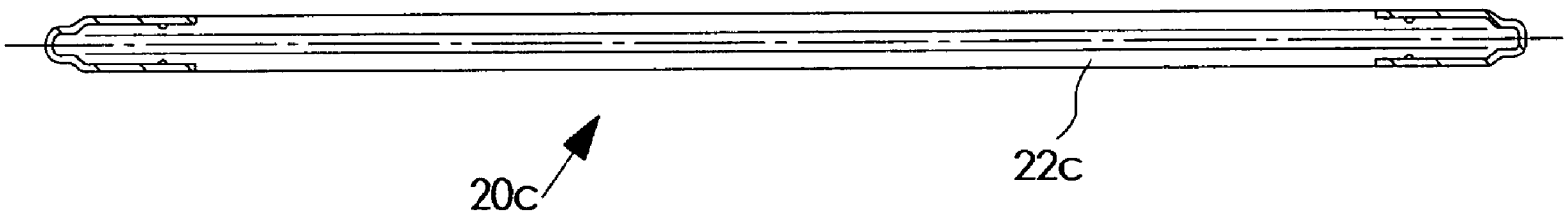
FIG. 7 is a side, elevational view of an engine pushrod which is in accordance with still yet another embodiment of the present invention.

FIG. 7 illustrates an engine pushrod 20*c* which is very similar to that which is shown in FIG. 5, but where the engine pushrod 20*c*, and specifically the plastic rod portion 22*c* thereof, has a "T-shaped" cross-sectional profile, wherein a cross-sectional view of the plastic rod is as shown in FIG. 4.

Figure 8:
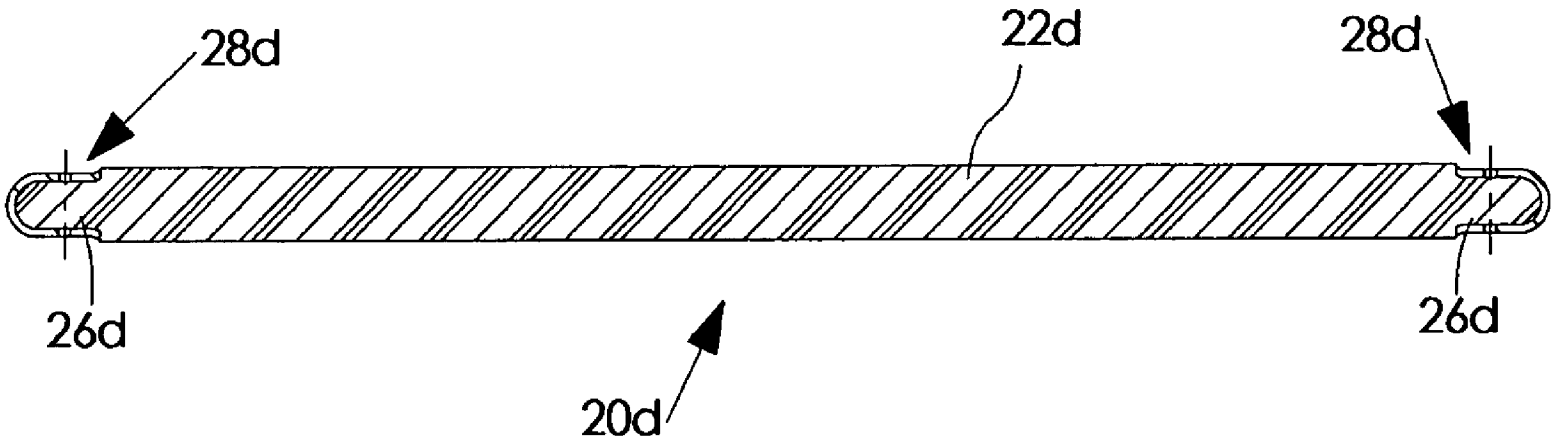
FIG. 8 is a side, elevational view of an engine pushrod which is in accordance with still yet another embodiment of the present invention.
Figure 10:
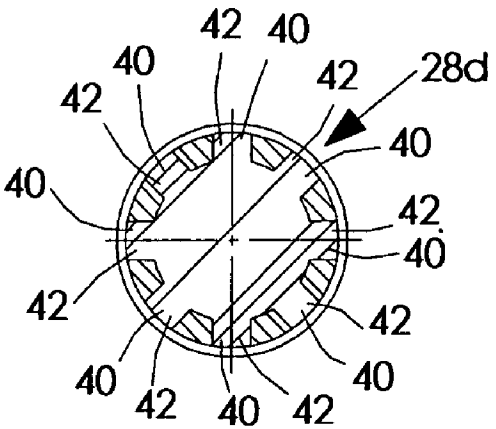
FIG. 10 is a cross-sectional view of the end cap shown in FIG. 10, taken along line 10—10 of FIG. 9.
Figure 9:
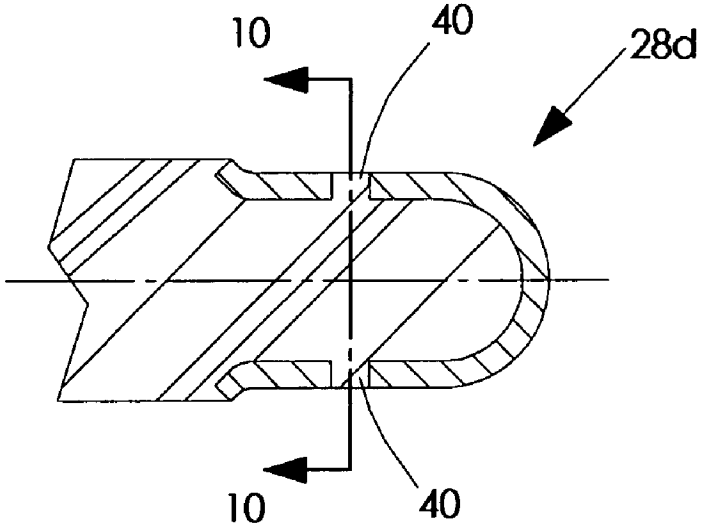
FIG. 9 is an enlarged, cross-sectional view of one of the end caps on the pushrod shown in FIG. 8.

FIG. 8 illustrates an engine pushrod 20*d* which has end caps 28*d* that have holes 40 formed therein (see FIGS. 9 and 10). Like the end caps shown in previous FIGURES, the end caps 28*d* shown in FIG. 8 are preferably stamped into a shape which corresponds to the shape of the end portions 26*d* of the plastic rod; however, the end caps 28*d* are insert molded onto the plastic rod 22*d* and the holes 40 are formed in the end caps 28*d* to allow plastic 42 to flow through the holes 40 while the engine pushrod 20*d* is being molded. The fact that the holes 40 are provided and plastic 42 flows into the holes 40 during molding provides enhanced securement between the end caps 28*d* and the molded plastic rod 22*d* and provides enhanced toque characteristics. Due to the fact that the end caps 28*d* are insert molded and not crimped onto the ends 26*d* of the plastic rod 22*d*, the end portions 26*d* of the rod 22*d* shown in FIG. 8 do not include circumferential notches (see FIG. 2).

Figure 11:
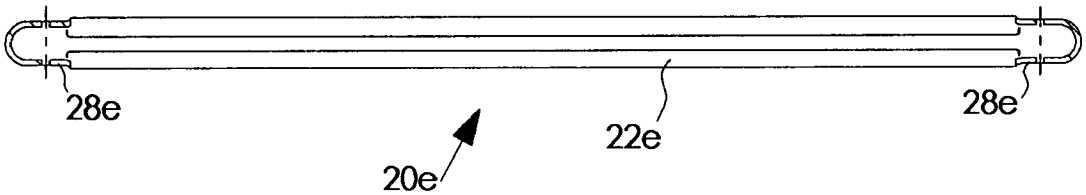
FIG. 11 is a side, elevational view of an engine pushrod which is in accordance with yet another embodiment of the present invention.

FIG. 11 illustrates an engine pushrod 20*e* which is very similar to that which is shown in FIG. 8 (including insert-molded end caps 28*e*), but where the engine pushrod 20*e*, and specifically the plastic rod portion 22*e* thereof, has a "T-shaped" cross-sectional profile, wherein a cross-sectional view of the plastic rod is as shown in FIG. 4.

Figure 12:
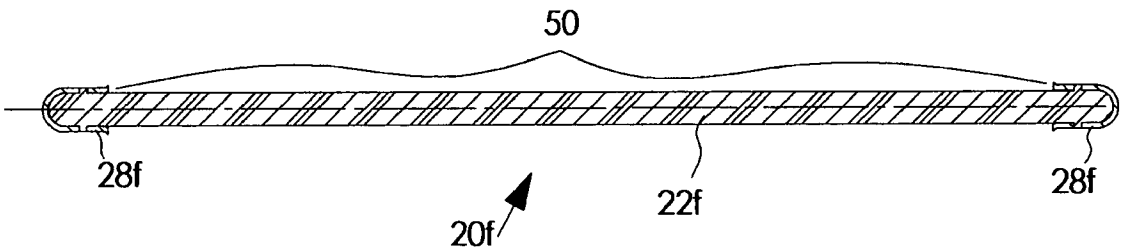
FIG. 12 is a partial, cross-sectional view of an engine pushrod which is in accordance with yet an other embodiment of the present invention.

FIG. 12 illustrates an engine pushrod 20*f* which is very similar to that which is shown in FIG. 8 (including insert-molded end caps 28*f*), but where the plastic rod portion 22*f* of the pushrod 20*f* has a reduced diameter portion 50 along the central length of the plastic rod 22*f*.

Figure 13:
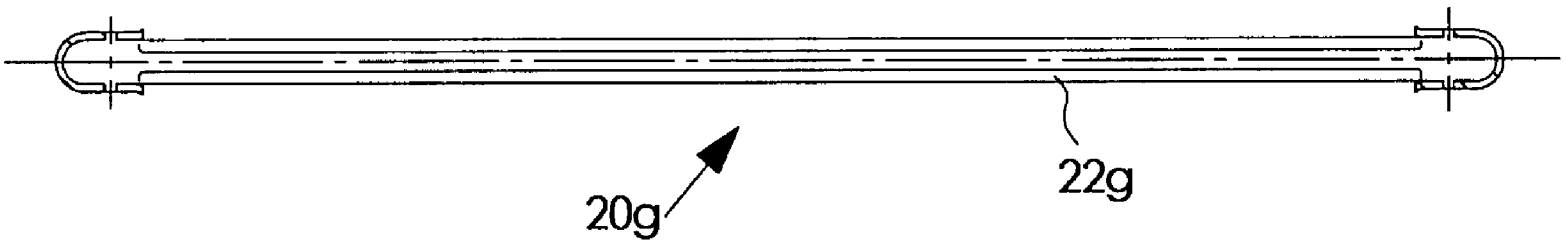
FIG. 13 is a side, elevational view of an engine pushrod which is in accordance with still yet another embodiment of the present invention.

FIG. 13 illustrates an engine pushrod 20*g* which is very similar to that which is shown in FIG. 12, but where the engine pushrod 20*g*, and specifically the plastic rod portion 22*g* thereof, has a "T-shaped" cross-sectional profile, wherein a cross-sectional view of the plastic rod would be as shown in FIG. 4.

Figure 14:
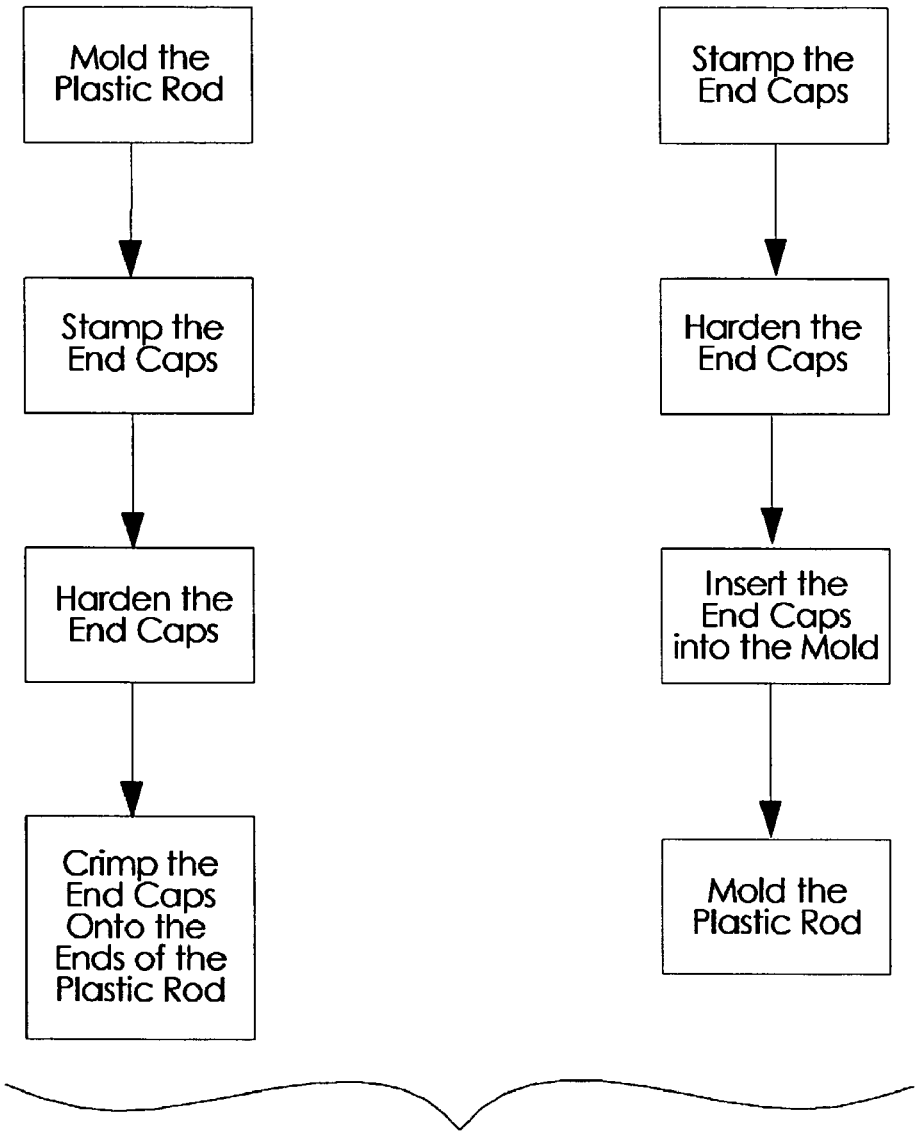
FIG. 14 illustrates methods which can be employed to make any of the pushrods shown in the previous FIGURES.

A method of making any of the pushrods 20–20*g* illustrated in the previous FIGURES is shown in FIG. 14. Specifically, the left side of FIG. 14 illustrates a method of making any of the pushrods where the end caps are crimped onto the ends of the plastic rod (i.e., pushrods, 20, 20*a*, 20*b*, 20*c*). The method includes molding the plastic rod (22, 22*a*, 22*b*, 22*c*), stamping the end caps (28, 28*a*, 28*b*, 28*c*) to the desired shape, hardening the end caps (28, 28*a*, 28*b*, 28*c*) and crimping the end caps (28, 28*a*, 28*b*, 28*c*) onto ends (26, 26*a*, 26*b*, 26*c*) of the plastic rod (22, 22*a*, 22*b*, 22*c*). The right side of FIG. 14 illustrates a method of making any of the pushrods where the end caps are insert molded (i.e., pushrods, 20*d*, 20*e*, 20*f*, 20*g*). The method includes stamping the end caps (28*d*, 28*e*, 28*f*, 28*g*) to the desired shape, hardening the end caps (28*d*, 28*e*, 28*f*, 28*g*), inserting the shaped, hardened end caps (28*d*, 28*e*, 28*f*, 28*g*) into the mold, and molding the plastic rod (22*d*, 22*e*, 22*f*, 22*g*) (thereby molding the resulting pushrod).

While embodiments of the present invention are shown and described, it is envisioned that those skilled in the art may devise various modifications of the present invention without departing from the spirit and scope of the disclosure.

What is claimed is:

1. An engine pushrod comprising a plastic shaft in the form of at least one of a tube and rod, said plastic shaft including at least one end having a shape, and an end cap on said at least one end of the plastic shaft of said engine pushrod, said end cap formed to the shape of said end of said plastic shaft of said engine pushrod wherein an entire inside surface of said end cap is contacted by plastic of said plastic shaft, said end cap having an end opening in which plastic is disposed as well as at least one hole in a surface of said end cap in which plastic of the plastic shaft is disposed wherein there is plastic disposed in each and every hole in said surface of said end cap, said plastic of the plastic shaft in said hole contributing to securement between the end cap and the plastic shaft of said engine pushrod, said end cap defining an end of said engine pushrod.

2. An engine pushrod as defined in claim 1, wherein the plastic shaft comprises a plastic rod.

3. An engine pushrod as defined in claim 1, further comprising a circumferential groove proximate the end of the plastic shaft.

4. An engine pushrod as defined in claim 1, wherein the end cap is crimped onto the end of die plastic shaft.

5. An engine pushrod as defined in claim 1, wherein the end cap is hardened.

6. An engine pushrod as defined in claim 1, wherein the end cap is metal.

7. An engine pushrod as defined in claim 1, wherein the plastic shaft includes a first end and a second end, said engine pushrod comprising a first end cap on the first end of thc plastic rod and a second end cap on the second end of the plastic rod.

8. An engine pushrod as defined in claim 7, further comprising a circumferential groove proximate each end of the plastic shaft.

9. An engine pushrod as defined in claim 7, wherein the end caps are crimped onto the ends of the plastic shaft.

10. An engine pushrod as defined in claim 7, wherein the end caps are hardened.

11. An engine pushrod as defined in claim 7, wherein the end caps are metal.

* * * * *

UNITED STATES PATENT AND TRADEMARK OFFICE

CERTIFICATE OF CORRECTION

PATENT NO. : 6,971,356 B2
APPLICATION NO. : 10/354282
DATED : December 6, 2005
INVENTOR(S) : Stephen Alan Diestelmeier It is certified that error appears in the above-identified patent and that said Letters Patent is hereby corrected as shown below:

Column 5, Line 2 "of die plastic" should be
-- of the plastic --

Signed and Sealed this

Fifteenth Day of August, 2006

JON W. DUDAS
*Director of the United States Patent and Trademark Office*